US005697296A

United States Patent [19]

Thünker et al.

[11] Patent Number: 5,697,296

[45] Date of Patent: Dec. 16, 1997

[54] POSITIONING DEVICE FOR A RUBBER-BLANKET CYLINDER

[75] Inventors: Norbert Thünker, Hirschberg; Martin Mayer, Ladenburg; Werner Weber, Sandhausen, all of Germany

[73] Assignee: Heidelberger Druckmaschinen AG, Heidelberg, Germany

[21] Appl. No.: 639,425

[22] Filed: Apr. 29, 1996

[30] Foreign Application Priority Data

Apr. 28, 1995 [DE] Germany ..... 195 15 692.7

[51] Int. Cl.[6] ..... B41F 7/02

[52] U.S. Cl. ..... 101/216; 101/212

[58] Field of Search ..... 101/216, 212

[56] References Cited

U.S. PATENT DOCUMENTS

| | | | |
|---|---|---|---|
| 3,366,047 | 1/1968 | Hermach et al. | 101/216 |
| 4,183,297 | 1/1980 | Skiera | 101/218 |
| 4,509,425 | 4/1985 | Hahn et al. | 101/216 |
| 4,598,640 | 7/1986 | Nawrath | 101/177 |
| 4,815,377 | 3/1989 | Skiera | 101/218 |

FOREIGN PATENT DOCUMENTS

| | | | |
|---|---|---|---|
| 753 695 | 11/1952 | Germany . | |
| 1 227 916 | 5/1967 | Germany . | |
| 1 536 416 | 2/1973 | Germany . | |
| 2718856 | 3/1978 | Germany . | |
| 34 12 812 | 6/1985 | Germany . | |
| 3819159A1 | 1/1989 | Germany . | |
| 970329 | 9/1964 | United Kingdom | 101/216 |
| 1181902 | 2/1970 | United Kingdom . | |

*Primary Examiner*—Edgar S. Burr
*Assistant Examiner*—Daniel J. Colilla
*Attorney, Agent, or Firm*—Herbert L. Lerner; Laurence A. Greenberg

[57] ABSTRACT

A positioning device for a rubber-blanket cylinder which is supported in double-excentric bearing rings allows a positional adjustment of the rubber-blanket cylinder relative to a plate cylinder and a printing substrate supported on an impression cylinder. The plate cylinder and the impression cylinder have stationary axes of rotation relative to the frame of the printing unit. A printing gap is adjusted by the positioning device to varying printing substrate thickness, and in one terminal position, the rubber-blanket cylinder is fully disengaged from the other cylinders. The rubber-blanket cylinder is shifted along a positioning path with one segment following an arc of a circle which is concentric with the plate cylinder. The parameters of the bearing and the adjusting devices are defined such that the positioning path is traversed while the respective inner and outer bearing rings rotate continuously.

8 Claims, 5 Drawing Sheets

POSITIONING DEVICE FOR A RUBBER-BLANKET CYLINDER

BACKGROUND OF THE INVENTION

1. Field of the Invention

The invention relates to offset printing presses and, in particular, to a positioning device for a rubber-blanket cylinder; the rubber-blanket cylinder, in operation, rolls on a plate cylinder and on a printing substrate supported on an impression cylinder of a printing unit in an offset printing press; the plate cylinder, the rubber blanket cylinder and the impression cylinder define respective axes of rotation that span imaginary planes, the imaginary planes enclosing an imaginary prism with a triangular cross section; the vertex of that triangle is obtuse and it coincides with the axis of rotation of the rubber-blanket cylinder; the rotational axes of the plate cylinder and of the impression cylinder are stationary with respect to the printing unit; a bearing configuration is disposed in each side wall of the printing unit for rotationally mounting the rubber-blanket cylinder; the bearing configurations each comprises a pair of bearing rings in the form of an inner ring holding the rubber-blanket cylinder, with an inner-ring axis, and an outer ring with an outer-ring axis; the outer ring supports the inner ring rotatably in the side wall and is rotatably held in one of the side walls; the bearing rings kinematically forming a crank with coupling link, of which crank with coupling link a first arm, swivellable about the outer-ring axis, is represented by a first eccentricity provided on the outer ring and a second arm, swivellable about the inner-ring axis, is represented by a second eccentricity provided on the inner ring, with transmission means connected, at one end, to the respective inner ring and the respective outer ring and, at the other end, to positioning means, the transmission means causing—when moved with the positioning means—the simultaneous rotation of the inner ring and of the outer ring from a respective starting position into a respective end position and thus causing the displacement of the axis of rotation of the rubber-blanket cylinder along a positioning path extending transversely to the axis of rotation; when the inner ring and the outer ring are in their respective starting positions, the rubber-blanket cylinder is in engagement, under respectively specified contact pressures, with the plate cylinder and with the impression cylinder.

2. Description of the Related Art

There has been known heretofore from German patent DE 34 12 812 C1 a positioning device for a pair of rubber-blanket cylinders, the pair of rubber-blanket cylinders being a component of a printing unit of a web-fed rotary offset printing press, wherein, in addition to its function of transferring ink onto the printing substrate, each rubber-blanket cylinder supports the printing substrate against the action of the respectively other rubber-blanket cylinder. The rubber-blanket cylinders and respective plate cylinders cooperating therewith are disposed in such a manner that the rotation axes thereof lie approximately in an imaginary plane extending obliquely relative to the transport direction of the printing substrate. Each bearing journal of the rubber-blanket cylinders is rotatably held in an eccentric inner ring of a bearing configuration. The inner ring, in turn, is rotatably held in an eccentric outer ring rotatably supported in the printing unit. A transmission is articulatingly connected to each inner ring and to each outer ring. It is possible by means of the transmission for each inner ring and each outer ring to be rotated in such a manner that, during the aforementioned rotation, the axes of rotation of the two rubber-blanket cylinders sweep imaginary planes perpendicular to the aforementioned imaginary plane and, depending on the direction of rotation, move away from or towards each other.

The purpose of that prior art positioning device is for the rubber-blanket cylinders to be disposed—for example for the purpose of covering them with new rubber blankets—such that they can be separated from each other without displacing any of the other printing-unit cylinders.

SUMMARY OF THE INVENTION

It is accordingly an object of the invention to provide a positioning device for a rubber-blanket cylinder, which overcomes the above-mentioned disadvantages of the prior art devices of this general type, and wherein the setting of the printing gap to the printing-substrate thickness has no repercussions with regard to the contact pressure between the rubber-blanket cylinder and the plate cylinder.

With the foregoing and other objects in view there is provided, in accordance with the invention, a positioning device for a rubber-blanket cylinder of a printing unit of an offset printing press. The printing unit has a rubber-blanket cylinder, a plate cylinder, an impression cylinder, and printing unit sidewalls, and, in operation, the rubber-blanket cylinder rolls on the plate cylinder and on a printing substrate supported on the impression cylinder, wherein the plate cylinder, the rubber-blanket cylinder and the impression cylinder each define a respective axis of rotation, the axes together spanning imaginary planes enclosing an imaginary prism with a triangular cross section having an obtuse vertex located on the axis of rotation of the rubber-blanket cylinder, and wherein the axes of rotation of the plate cylinder and of the impression cylinder are stationary with respect to the printing unit;

The positioning device for the rubber-blanket cylinder according to the invention comprises:

bearing configurations each disposed in one of the side walls of the printing unit for rotatably supporting the rubber-blanket cylinder, the bearing configurations each comprising a pair of bearing rings including an inner ring, supporting the rubber-blanket cylinder and having an inner-ring axis, and an outer ring having an outer-ring axis, the outer ring rotatably supporting the inner ring and being rotatably mounted in one of the side walls; the bearing rings kinematically forming a crank with a coupling link including a first arm, swivellable about the outer-ring axis, defined with a first eccentricity on the outer ring, and a second arm, swivellable about the inner-ring axis, defined by a second eccentricity on the inner ring;

a transmission having a first end connected to a respective the inner ring and a respective the outer ring, and a second end connected to a positioning member, the transmission—when being moved by the positioning member—causing a simultaneous rotation of the inner ring and of the outer ring from a respective starting position into a respective end position and displacing the axis of rotation of the rubber-blanket cylinder along a positioning path defined transversely to the axis of rotation of the rubber-blanket cylinder;

the starting positions of the inner ring and of the outer ring being defined such that the rubber-blanket cylinder is in engagement, under defined contact pressures, with the plate cylinder and with the impression cylinder;

the second arm of the crank having a length greater by a multiple than a length of the first arm of the crank;

the second arm of the crank being oriented along a first main direction substantially radial with respect to the axis of rotation of the plate cylinder, when the inner ring is in the starting position, in an end position and in transitional positions therebetween;

the first arm of the crank being oriented along a second main direction substantially perpendicular with respect to the first main direction, when the outer ring in the starting position, in an end position and in transitional positions therebetween;

a rotation of the inner ring and of the outer ring from the starting positions into the end positions causing the axis of rotation of the rubber-blanket cylinder to increasingly move away from the plane spanned by the axes of rotation of the plate cylinder and of the impression cylinder, whereby the axis of rotation of the rubber-blanket cylinder first passes through a first positioning-path segment substantially describing an arc of a circle concentric with the plate cylinder; and subsequently passes through an adjoining second positioning-path segment becoming increasingly distant from the plate cylinder.

In other words, the object of the invention is satisfied with a positioning device of the above kind which has a second arm of the crank with a coupling link having a length that is greater by a multiple than that of the first arm of the crank with a coupling link; furthermore, when the inner ring is in its starting position, in its end position, and in transitional positions therebetween, the second arm of the crank has orientations with a first main direction essentially radial with respect to the axis of rotation of the plate cylinder; when the outer ring is in its starting position, in its end position and in transitional positions therebetween, the first arm of the crank has orientations with a main direction essentially perpendicular to the first main direction. During the rotation of the inner ring and of the outer ring from their starting positions into their end positions with increasing distance from the plane spanned by the rotational axes of the plate cylinder and of the impression cylinder, the axis of rotation of the rubber-blanket cylinder first of all passes through a first positioning-path segment. That first segment describes—to a large degree of approximation—an arc of a circle that shares its center with the plate cylinder. The first positioning-path segment is followed by a second positioning-path segment, the second positioning-path segment becoming increasingly distant from the plate cylinder.

The end of the first positioning-path segment distal from the second positioning-path segment corresponds to a setting of the printing gap to a minimum printing-substrate thickness, while the end of the first positioning-path segment facing the second positioning-path segment corresponds to a position of the rubber-blanket cylinder in a first "impression off" stage. Finally the end of the second positioning-path segment distal from the first positioning-path segment corresponds to a position of the rubber-blanket cylinder in a second "impression off" stage, in which the rubber-blanket cylinder is disengaged both from the impression cylinder and also from the plate cylinder.

With the positioning device according to the invention, the adaptation of the printing gap to increasingly large printing-substrated thicknesses is accomplished by setting the axis of rotation of the rubber-blanket cylinder to locations along the first positioning-path segment with an increasing distance of the locations from the end of the first positioning-path segment distal from the second positioning-path segment. The accomplished adaptation of the printing gap to the printing-substrate thickness has no bearing on a contact pressure set between the rubber-blanket cylinder and the plate cylinder inasmuch as, during the displacement of its axis of rotation along the first positioning-path segment, the rubber-blanket cylinder moves substantially along the arc of a circle which is concentric with the plate cylinder.

In a preferred embodiment of the invention, the positioning path has a turning point at which the second positioning path segment adjoins the first positioning-path segment. This guarantees, in particular, a quick release of the rubber-blanket cylinder from the plate cylinder when a transition is made from the first "impression off" stage to the second "impression off" stage.

In accordance with an added feature of the invention, the positioning device comprises an adjustable stop, the stop delimiting the displacement—in a direction from the second positioning-path segment to the first positioning-path segment—of the axis of rotation of the rubber-blanket cylinder at a predetermined location on the first positioning-path segment. With the aid of the stop, the rubber-blanket cylinder when its axis of rotation is moved out of the "impression off" positions into an "impression on" position, always reaches an always identical location on the first positioning-path segment, i.e., a defined setting of the printing gap to a minimum printing substrate can always be reached by abutting the stop.

In accordance with an additional feature of the invention, the positioning device comprises adjusting means by means of which a first bearing ring of the pair of bearing rings is rotatable with respect to a second bearing ring, the instantaneous angular position of the second bearing ring of the pair of bearing rings being to a very large extent maintained. The bearing ring which will be selected as the first bearing ring is the one that, as a consequence of the changing of its angular positions while passing through the first positioning-path segment, counteracts the tendency (caused by the other bearing ring through its simultaneous rotation) for the axis of rotation of the rubber-blanket cylinder to be moved away from the circular path of the first positioning-path segment, with the result that a change in the angular orientation of the thus selected first bearing ring (accomplished with the aid of the adjusting means) is accompanied by a change in the contact pressure between the rubber-blanket cylinder and the plate cylinder.

The transmission is formed, in a first embodiment of the positioning device, by a link mechanism and, in a second embodiment, by a cam drive. In particular, an embodiment of the first variant is a configuration with a driving rocker swivellable by means of the positioning means, the driving rocker being held in a stationary bearing with a swivel axis parallel to the axis of rotation of the rubber-blanket cylinder, a first link connected, at one end, to the inner ring and, at the other end (a first articulation point) to the driving rocker. A second link is connected, at one end, to the outer ring and, at the other end (a second articulation point) to the driving rocker.

A further embodiment of the first variant is defined with a configuration of the transmission as follows: a crank arm is swivellable by the positioning means, the crank arm being mounted in a stationary crank bearing with a crank axis parallel to the axis of rotation of the rubber-blanket cylinder. A coupling rod is connected, at one end, to a first bearing ring of the pair of bearing rings and, at the other end, to the crank arm. And a guide lever is connected, at one end, to a second bearing ring of the pair of bearing rings and, at the other end, to the coupling rod. The coupling rod, on the one hand, and the guide lever, on the other hand, have effective directions that enclose an angle different from 90°.

In accordance with a concomitant feature of the invention, the transmission is a cam drive which includes a first cam follower connected to the inner ring and a second cam follower connected to the outer ring. It also includes a control-cam configuration which cooperates with the cam followers. A first cam track controls the first cam follower and a second cam track controls the second cam follower. The control-cam configuration is adjustable by way of the positioning means. Further preferred in this context is an embodiment in which a control disc is provided, the control disc carrying the two cam tracks.

Other features which are considered as characteristic for the invention are set forth in the appended claims.

Although the invention is illustrated and described herein as embodied in a positioning device for a rubber-blanket cylinder, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
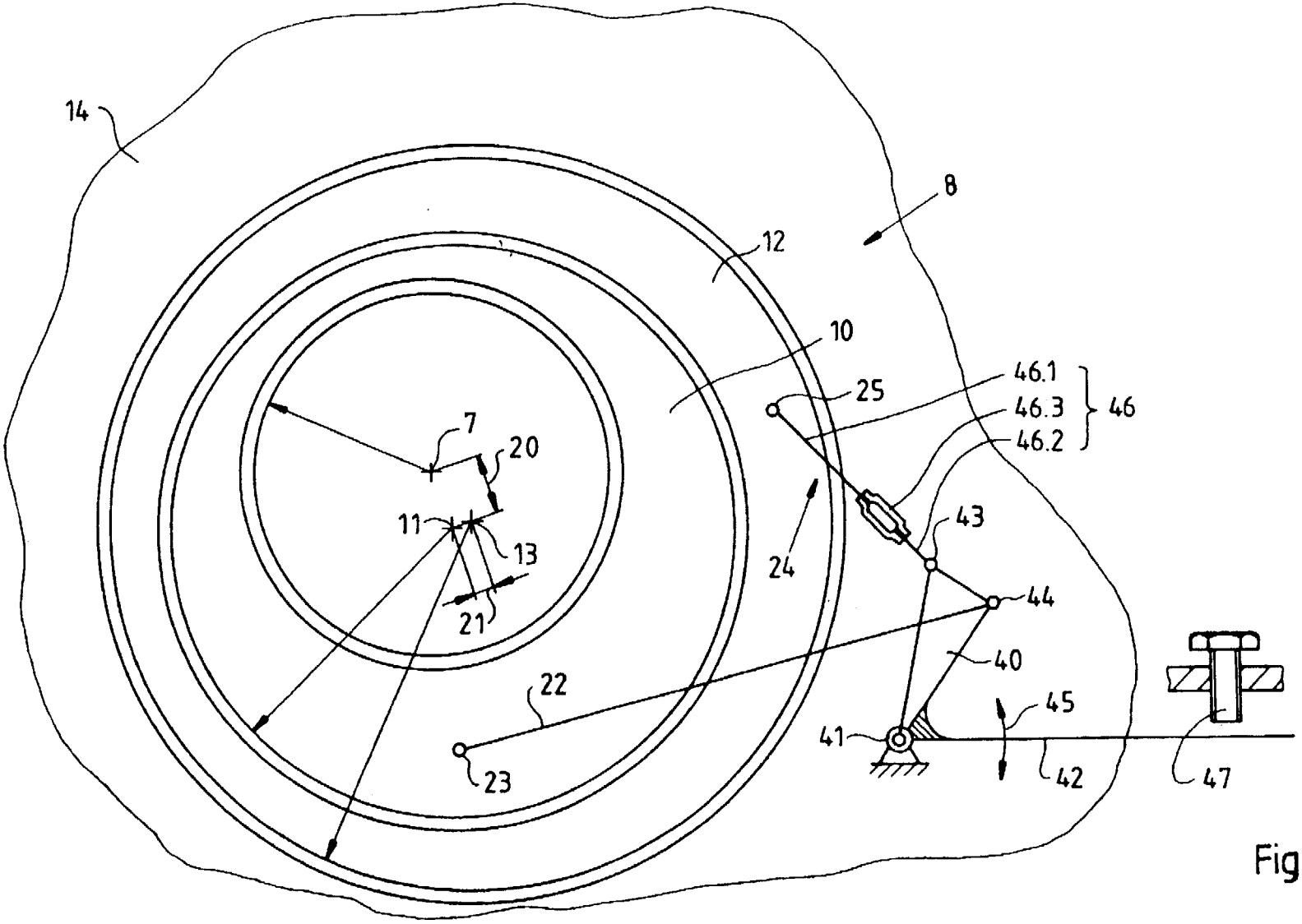
FIG. 1 is a schematic side view of a positioning device according to the invention with a first embodiment of the transmission means in the form of a link mechanism.

Referring now to the figures of the drawing in detail and first, particularly, to FIG. 1 thereof, there is seen an eccentric outer ring 12, which is rotatably mounted in each of the printing unit side walls 14. The outer ring 12 rotates about an outer-ring axis 13. An eccentricity 21 of the outer ring 12 is determined by a distance of the outer-ring axis 13 from an inner-ring axis 11. The inner-ring axis 11 is defined by an eccentric inner ring 10, which is rotatably mounted in the outer ring 12. The inner ring 10 and the outer ring 12 together form a bearing configuration 8 of a pair of bearing rings. An eccentricity 20 of the inner ring 10 is defined by a distance of the inner-ring axis 11 from an axis of rotation 7 of a rubber-blanket cylinder 1 (cf. FIGS. 3, 4). The rubber blanket cylinder 1, which is supported in the inner ring 10, rotates about the axis of rotation 7. In this connection, corresponding bearing points may be in the form of sliding bearings or rolling-contact bearings.

Figure 2:
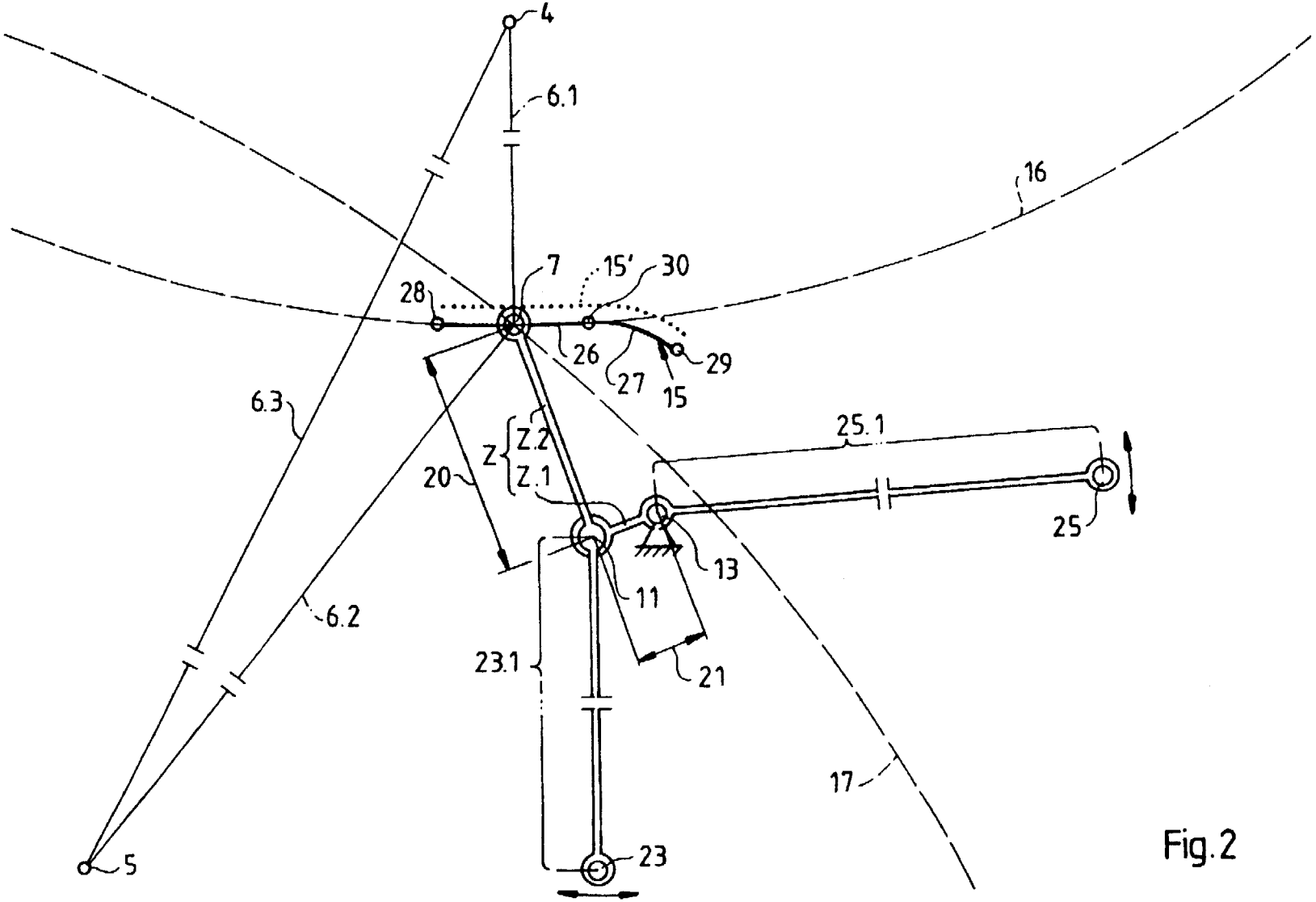
FIG. 2 is a qualitative representation of an equivalent drive mechanism for the bearing configuration and of the positioning path of the axis of rotation of the rubber-blanket cylinder.
Figure 3:
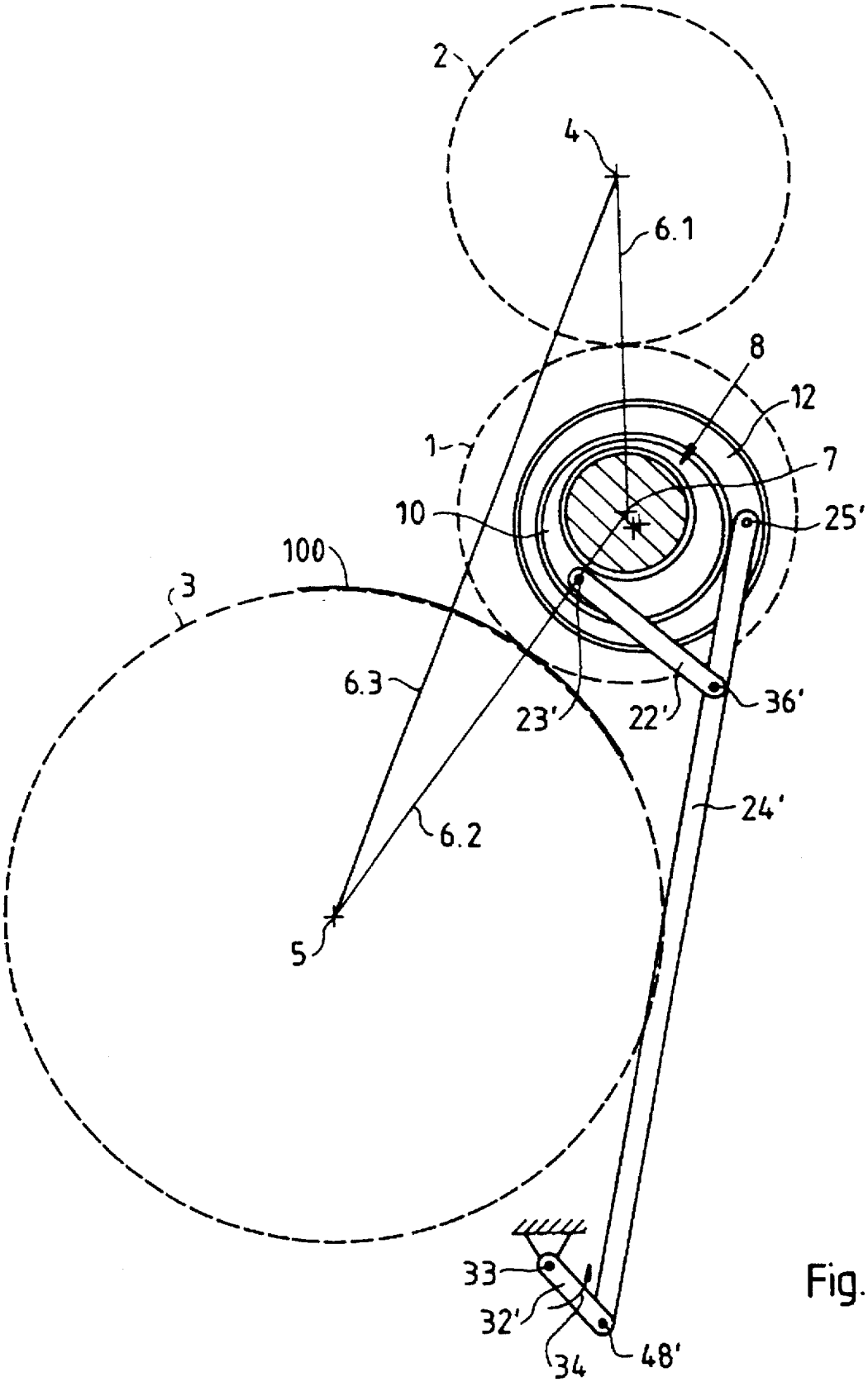
FIG. 3 is a schematic view of a combination with a plate cylinder, a rubber-blanket cylinder, an impression cylinder, and a second embodiment of the positioning device according to the invention, wherein the transmission is a coupling mechanism.
Figure 4:
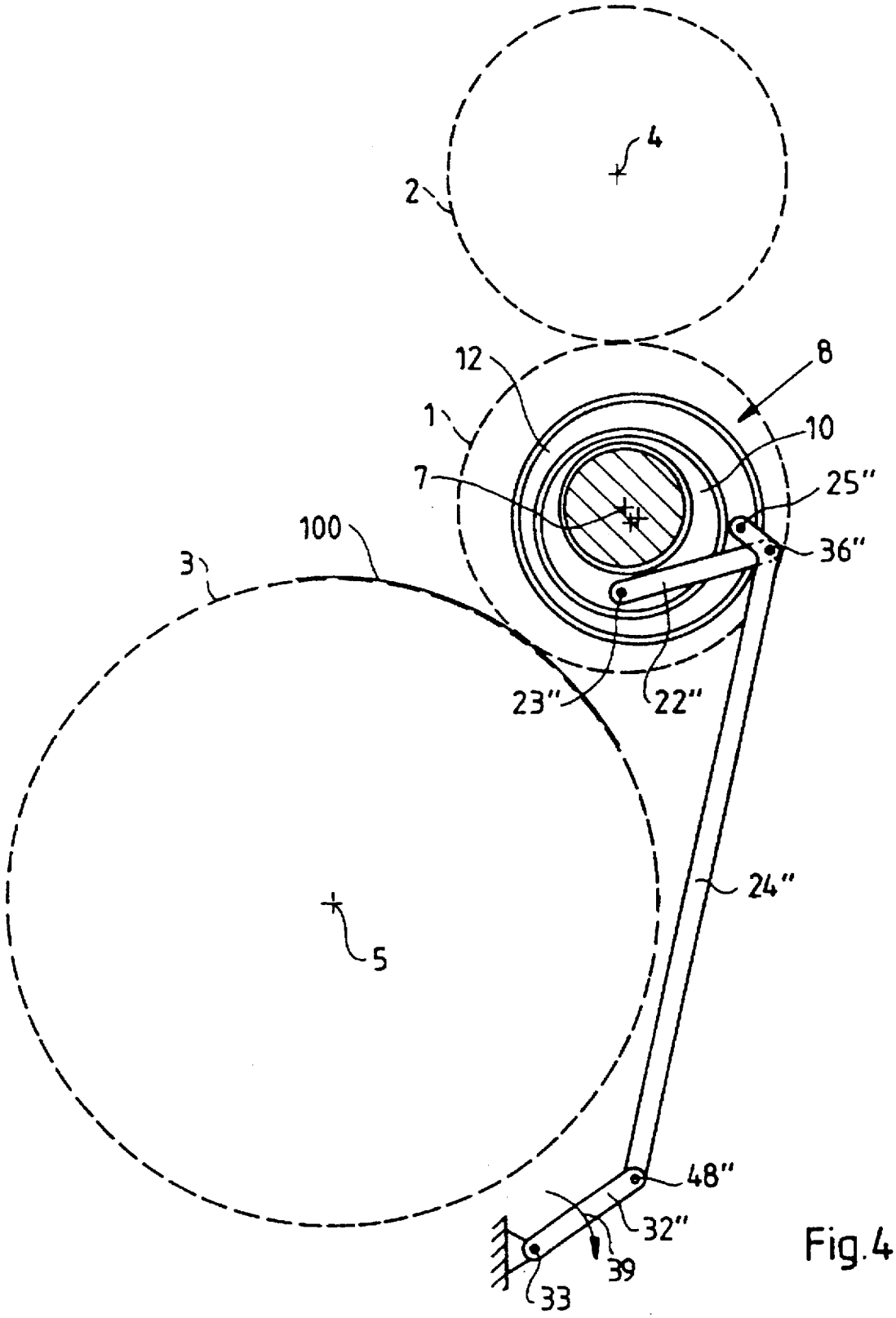
FIG. 4 is a similar view as that of FIG. 3 showing a further embodiment of the transmission in the form of a coupling mechanism.

With reference to FIGS. 3 and 4, there is shown the position of the rubber-blanket cylinder 1 with respect to an associated plate cylinder 2 and an associated impression cylinder 3. The rubber-blanket cylinder 1, the plate cylinder 2 and the impression cylinder 3 have rotational axes 7, 4, 5, respectively, that span imaginary planes 6.1, 6.2, 6.3. The imaginary planes 6.1, 6.2, 6.3 enclose an imaginary prism. The prism has a cross section in the form of a triangle with a vertex of an obtuse angle situated on the axis of rotation 7 of the rubber-blanket cylinder 1. In operation, the rubber-blanket cylinder 1 rolls on the plate cylinder 2 and on a printing substrate 100 supported by the impression cylinder 3 and, with the inner ring 10 and the outer ring 12 in their respective starting positions, is in engagement—under respectively specified contact pressure—with the plate cylinder 2 and with the impression cylinder 3. In the aforementioned starting positions, the axis of rotation 7 of the rubber-blanket cylinder 1 is situated at a first end 28 proximal to the plane 6.3 of a positioning path 15 (FIG. 2), while, with the inner ring 10 and the outer ring 12 in their respective end positions, the axis of rotation 7 is situated at a second end 29 of the positioning path 15 distal from the plane 6.3. The positioning path 15 comprises a first positioning-path segment 26 proximal to the plane 6.3 and an adjoining, second positioning-path segment 27 distal from the plane 6.3. The first positioning-path segment 26 follows—at least approximately—an arc of a circle 16 concentric with the plate cylinder 2. The second positioning-path segment 27, with increasing distance from the first positioning-path segment 26, becomes increasingly more distant from the plate cylinder 2. The result of this transverse orientation of the positioning path 15 with respect to the axis of rotation 7 of the rubber-blanket cylinder 1 is that—in the course of the displacement of the axis of rotation 7 of the rubber-blanket cylinder 1 (starting from the first end 28 of the positioning path 15 and moving towards the second end 29) as a consequence of the simultaneous rotation of the inner ring 10 and the outer ring 12 out of their respective starting positions into their respective end positions—the rubber-blanket cylinder 1 first of all forms a printing gap at the impression cylinder 3 adapted to increasingly thicker printing-substrates, and subsequently reaches a first "impression off" stage (in which the rubber-blanket cylinder 1 just barely remains in contact with the plate cylinder 2) and finally reaches a second "impression off" stage, in which the contact with the plate cylinder 2 has also been lost. The plate cylinder 2 has a stationary axis of rotation 4 with respect to the side walls 14 and the impression cylinder 3 has a corresponding stationary axis of rotation 5.

The positioning device shown in FIG. 1 is a first embodiment of the transmission means. A driving rocker 40 is swivellably held about a stationary bearing 41 with a swivel axis parallel to the axis of rotation 7 of the rubber-blanket cylinder 1. A lever 42, serving as the positioning means for actuating the transmission means, is permanently connected to the driving rocker 40. The lever 42 swivels about the shaft of the bearing 41 in directions following the double arrow 45. The transmission means include a first link 22. The first link 22 is connected at one end to the inner ring 10 and, at a first articulation point 44, to the driving rocker 40. The transmission means also include a second link 24. The second link 24 is connected at one end to the outer ring 12 and at the other end, at a second articulation point 43, to the driving rocker 40. Consequently, the transmission means are connected, at one end, to the inner ring 10 and the outer ring 12 of a respective bearing configuration 8 and, at the other end, to positioning means.

In order to implement the positioning path 15 according to the invention as shown in FIG. 2, the first positioning-path segment 26, which at least approximately describes an arc of a circle 16 concentric with the plate cylinder, is approximated in particular by three successive locations on such a circle and the parameters of the positioning device are determined for each of those locations. For this purpose, first of all, the sizes of the eccentricities 20 and 21 and the reciprocal rotational positions of the inner ring 10 and the outer ring 12 are selected such that the displacement of the axis of rotation 7 of the rubber-blanket cylinder 1 from the first end 28 of the positioning path 15 to the second end 29 thereof is elected under constant rotation of the inner ring and the outer ring 12. The respective outer ring 12 (rotatable about the outer-ring axis 13 and rotatably held in the respective side wall 14) and its eccentricity 21 as well as the respective inner ring 10 (held in the outer ring 12 and rotatable about the inner-ring axis 11 and rotatably holding the rubber-blanket cylinder 1) and its eccentricity 20 form a kinematic crank with a coupling link Z.

A first arm Z.1 of the coupling link Z is swivellable about the outer-ring axis 13 and it is represented by the first eccentricity 21 provided on the outer ring 12. A second arm Z.2 is swivellable about the inner-ring axis 11 and is represented by the second eccentricity 20 provided on the inner ring 10. The second arm Z.2 describes the positioning path 15 with its free end during the aforementioned simultaneous rotation of the inner ring 10 and the outer ring 12 from their respective starting positions into their respective end positions. The eccentricities 20 and 21 are specified such that the second arm Z.2 of the crank with the coupling link Z is of a length that is greater by a multiple than that of the first arm Z.1 of the crank with the coupling link Z. Consequently, the eccentricity 20 of the inner ring 10 is a multiple of the eccentricity 21 of the outer ring 12.

An example of the size ratio of the eccentricities 20 and 21 and of the reciprocal rotational positions of the inner ring 10 and the outer ring 12 is illustrated in FIG. 2, which represents the kinematic conditions ensuing from the above-described mounting of the rubber-blanket cylinder 1 and from the above-described connection of the link 22 at the articulation point 23 as well as of the link 24 at the articulation point 25. The representation is in the form of an equivalent drive mechanism, of which, in particular, the first arm Z.1 and the second arm Z.2 of the crank with the coupling link Z are visible. As for the rest, the drive-mechanism section 23.1 of the equivalent drive mechanism symbolizes a fictitious rigid connection between the articulation point 23 and the inner-ring axis 11, while the drive-mechanism section 25.1 symbolizes a corresponding connection between the articulation point 25 and the outer ring 12. A broken line indicates the circle 16 concentric with the plate cylinder 2. The circle 16 is followed, at least approximately, by the first positioning-path segment 26. A further broken line indicates a circle 17 described about the axis of rotation 5 of the impression cylinder 3. The circle 17 intersects the first positioning-path segment 26 at a location thereof at which, when assumed by the axis of rotation 7 of the rubber-blanket cylinder 1, the rubber-blanket cylinder 1 just touches the impression cylinder 3 under specified contact pressure with respect to the plate cylinder 2. Conversely, if the axis of rotation 7 is in the respective starting positions of the inner ring 10 and the outer ring 12, there is also a specified contact pressure between the rubber-blanket cylinder 1, on the one hand, and the impression cylinder 3, on the other hand.

In order to implement the positioning path 15, the reciprocal rotational positions of the inner ring 10 and the outer ring 12 are further specified in such a manner that, with the inner ring 10 in its starting position, in its end position and in transitional positions therebetween, the second arm Z.2 of the crank with the coupling link Z has orientations with a first main direction essentially radial with respect to the axis of rotation 4 of the plate cylinder 2 and, with the outer ring 12 in its starting position, in its end position and in transitional positions therebetween, the first arm Z.1 of the crank with the coupling link Z has orientations with a second main direction essentially perpendicular to the first main direction. Particularly with regard to the aforementioned exemplary embodiment with transmission means in the form of a link mechanism, it must be ensured—with respect to the orientations of the second arm Z.2 and thus, overall, with respect to the mounting of the rubber-blanket cylinder 1—that the second arm Z.2 is not aligned precisely radially with respect to the axis of rotation 4 of the plate cylinder 2, at least not in any of those transitional positions that the second arm Z.2 assumes when its free end moves along the first positioning-path segment 26. This is so because otherwise it would be necessary to provide a reversal of direction in the course of the rotation of the outer ring 12 or of the first arm Z.1. The accordingly specified orientations in order to implement the aforementioned positioning path 15 result ultimately in transmission means that may be formed by means of the driving rocker 40 and the links 22 and 24, the parameters of the transmission means being determined such that the movement of the transmission means results in a constant rotation both of the inner ring 10 and also of the outer ring 12.

Those parameters include, first of all, the location of the stationary, articulated connection of the transmission means, in this case by means of the bearing 41 for the driving rocker 40. That location is defined in view of the structural design characteristics and the space-related conditions of the printing unit such that no extremely unfavorable values are to be expected from effective transmission angles between the links 22 and 24, on the one hand, and the driving rocker 40, on the other hand, as well as between the links 22 and 24, on the one hand, and the bearing configuration 8, on the other hand.

Furthermore, those parameters include the coordinates of the locations of the articulation points 23 and 25 and of the articulation points 44 and 43. The locations are determined by calculation. It is thereby advantageous, yet not mandatory, for the calculation to include the defined condition that the articulation points 23 and 25 situated on the inner ring 10 and on the outer ring 12 be provided at least in the vicinity of the greatest ring thickness of the inner ring 10 and the outer ring 12.

In the example shown in FIG. 2, the axis of rotation 7 of the rubber-blanket cylinder 1 passes through the positioning path 15 according to the invention starting from the first end 28 thereof with the swivelling of the positioning means (shown as the lever 42) in a counter-clockwise direction. The links 22 and 24 between the articulation points 23, 44 and 25, 43 convert the swivelling into a rotational movement (likewise in a counter-clockwise direction) of the outer ring 12 and into a rotational movement (in the opposite direction thereto) of the inner ring 10.

As shown in FIG. 2. in the present example, a turning point 30 forms the transition between the first positioning-path segment 26 and the second positioning-path segment 27. According to the invention, the first positioning-path segment 26 follows to a very large extent the circle 16 (drawn in FIG. 2 with a broken line) around the axis of rotation 4 of the plate cylinder 2 (not illustrated in FIG. 2), while the second positioning-path segment 27, starting from the turning point 30, becomes increasingly distant from the plate cylinder 2 towards its end point 29.

Also with reference to FIG. 2, the above-mentioned crank with the coupling link Z is disposed outside the circle 16, and the inner-ring axis 11 is situated between the outer-ring axis 13 and the plane 6.3. It is also conceivable for a corresponding crank with a coupling link to be disposed inside the circle 16.

Further indicated by a dotted line in FIG. 2 is a positioning path 15', which is radially displaced towards the axis of rotation 4 of the plate cylinder 2. If that position of the positioning path 15' is chosen, then there exists a greater contact pressure between the rubber-blanket cylinder 1 and the plate cylinder 2 as compared with the positioning path 15. In order to change the contact pressure, adjusting means 46 in the form of a turnbuckle 46.3 between pieces 46.1 and 46.2 of the link 24, are provided (FIG. 1). In conjunction with the aforedescribed position of the inner-ring axis 11—which moves about the outer-ring axis 13 when the outer ring 12 is rotated on a circular arc—there clearly results an increase in the contact pressure as the distance is reduced between the articulation points 25 and 43. In the example shown, this can be implemented by means of the corresponding actuation of the turnbuckle 46.3. The actuation results in a shortening or lengthening of the distance between the articulation points 25 and 43 and, accordingly, the outer ring 12 is rotated with respect to the inner ring 10 with the instantaneous angular position of the inner ring 10 being largely maintained.

The embodiment in FIG. 1 includes a stop 47 that is responsible for the reproducibility of a desired position of the rubber-blanket cylinder 1 when the rubber-blanket cylinder 1 is displaced out of its "impression off" positions into its "impression on" position; in the embodiment shown in FIG. 1, the stop 47 is formed by way of example with a stationarily supported adjusting screw. The adjusting screw limits the swivel motion (in a counterclockwise direction) of the lever 42.

Referring again to FIGS. 3 and 4, there are shown particularly advantageous solutions with regard to the accommodation of the transmission means in a printing unit. Selected for the placing of a stationary articulated connection of the transmission means is a location situated outside the periphery of the impression cylinder 3 and approximately at the level of the lowest generating line of the (in this case) half-speed impression cylinder 3. The location is situated, as for the rest, between the plane 6.1 and a parallel plane thereto through the axis of rotation 5 of the impression cylinder 3. The stationary articulated connection of the transmission means is provided in this case by a crank bearing 33 with a axis of rotation parallel to the axis of rotation 7 of the rubber-blanket cylinder 1. A crank arm 32' or 32" is rotatable with respect to the axis of rotation of the crank bearing 33 by means of positioning means (not shown here). The transmission means further comprise a coupling rod 24' or 24" (connected at one end, at an articulation point 25' or 25", to the outer ring and at the other end, at an articulation point 48' or 48", to the crank arm 32' or 32") as well as a guide lever 22' or 22" (connected at one end, at an articulation point 23' or 23", to the inner ring 10 and at the other end, at an articulation point 36' or 36", to the coupling rod 24' or 24").

In these exemplary embodiments, corresponding parameters of the positioning device are determined in a similar manner to the exemplary embodiment in FIG. 1, however with a further condition: The coupling rod 24', 24", on the one hand, and the guide lever 22', 22", on the other hand, have effective directions that enclose an angle different from 90°.

With regard to the arrangement of a corresponding crank with coupling link, i.e., with regard to the reciprocal rotational positions of the inner ring 10 and the outer ring 12 in the course of the sweeping of the positioning path 15 by the axis of rotation 7 of the rubber-blanket cylinder 1, there is, however, in the case of the example shown in FIG. 4 a difference with respect to the examples shown in FIG. 1 or 2 and FIG. 3 inasmuch as the outer-ring axis 13 is disposed between the inner-ring axis 11 and the plane 6.3. Whereas, in the examples shown in FIG. 1–3, the axis of rotation 7 of the rubber-blanket cylinder 1 passes through the positioning path 15 with the inner ring 10, on the one hand, and the outer ring 12, on the other hand, rotating in opposite directions. In the example of FIG. 4, the positioning path 15 is passed through with the inner ring 10 and the outer ring 12 rotating in the same direction. In any case, the arrangement of the crank with the coupling link Z and that of the cranks with coupling links (not shown) in the case of an embodiment according to FIG. 3 and 4 is such that the respective crank with a coupling link is situated outside the circle 16 indicated in FIG. 2; that the respective second arm of the cranks with coupling links is aligned radially with respect to the axis of rotation 4 of the plate cylinder 2 no earlier than when the axis of rotation 7 of the rubber-blanket cylinder 1, starting from the first end 28 of the positioning path 15, reaches the second positioning-path segment 27; and that, before the second positioning-path segment 27 is reached, the respective second arm assumes a position swivelled with respect to the inner-ring axis, the position being inclined towards the plane 6.3 with respect to the plane 6.1.

Consequently, in all of the above-described embodiments, the passing-through of the positioning path 15 from an "impression on" position to an "impression off" position takes place with the inner ring 10 rotating in a clockwise direction. In the case of the embodiment shown in FIG. 3, this requires the rotation of the crank arm 32' in a counterclockwise direction and, in the case of the embodiment shown in FIG. 4, the rotation of the crank arm 32' in a clockwise direction, as is indicated by corresponding arrows 34 (FIG. 3) and 39 (FIG. 4).

In comparison with the embodiment shown in FIG. 1, however, the embodiments shown in FIG. 3 and 4 are characterized in that merely one single transmission member, extending into the region of the bearing configuration 8 or 8' and in the form of the coupling rod 24' or 24" is articulatingly connected to the crank arm 32' or 32". The crank arm 32' or 32" is comparable to the driving element 40 of FIG. 1.

Figure 5:
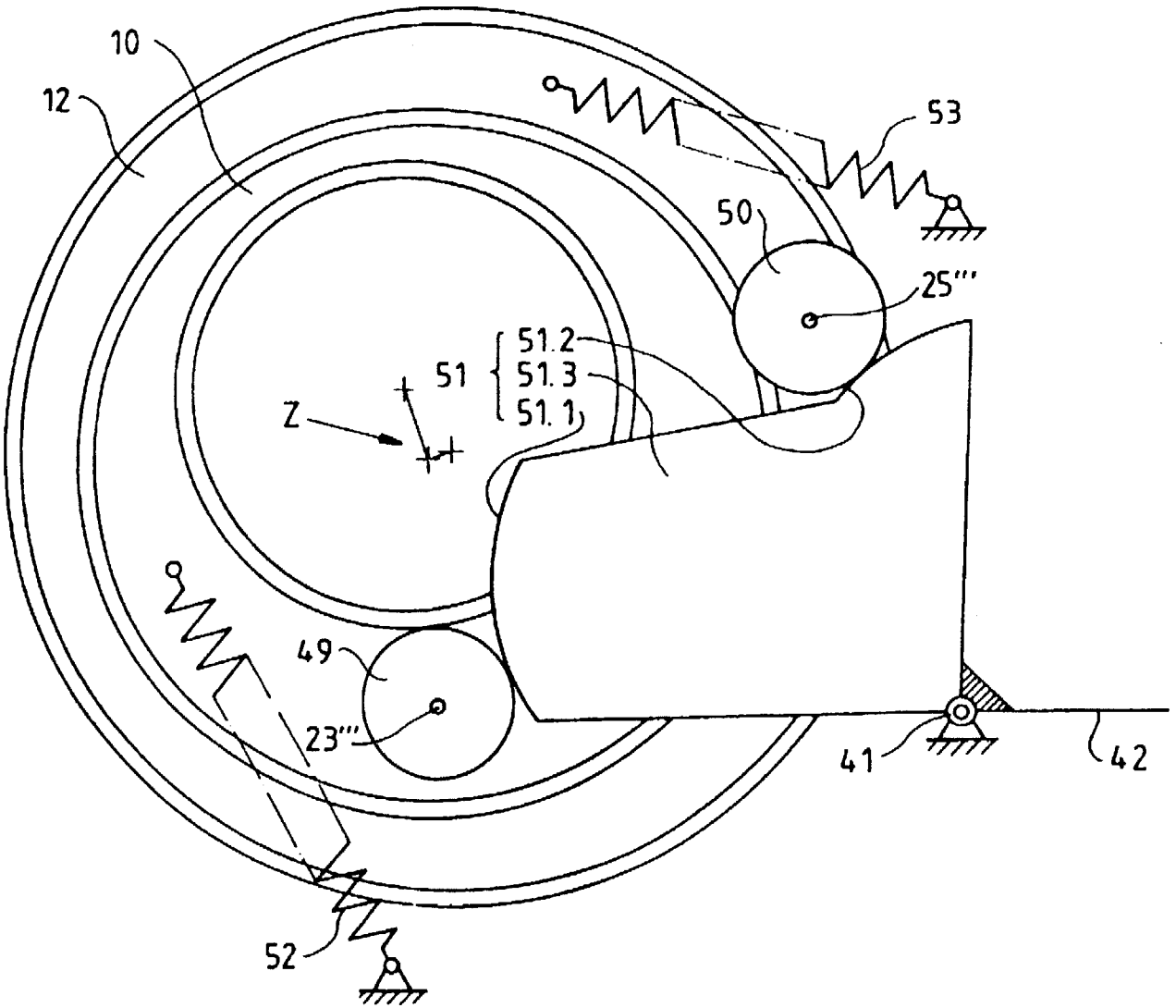
FIG. 5 is a schematic view of the positioning device with the transmission in the form of a cam drive.

The exemplary embodiment shown schematically in FIG. 5 allows any desired approximation of the positioning-path segment 26 to an arc of a circle concentric with the plate cylinder 2, as represented in FIG. 2 in the form of the circle 16. A bearing configuration 8' is provided for this purpose which corresponds to the example in FIG. 1 with regard to the formation and arrangement of the crank with coupling link Z. A first cam follower 49 and a second cam follower 50 are disposed on the inner ring 10 and the outer ring 12, respectively, each in the form of a cam roller held rotatably with respect to first and second roller shafts 23''' and 25'''. The positions of the roller shafts 23''' and 25''' correspond to those of the articulation points 23 and 25. The cam followers 49 and 50 have an effective connection to a control-cam arrangement 51 formed by means of a control disc 51.3. There are formed on the control disc 51.3 a first cam track 51.1, controlling the first cam follower 49, and a second cam track 51.2, controlling the second cam follower 50. The cam rollers (forming the cam followers 49 and 50) roll on the cam tracks 51.1 and 51.2 during the movement of the control-cam arrangement 51. The movement takes place with the swivelling of the control disc 51.3, which, for this purpose, is held by means of a bearing 41 with a swivelling shaft parallel to the roller shafts 23''' and 25'''. The swivel motion is caused by a positioning device in the form of a lever 42 permanently connected to the control disc 51.3.

The springs 52 and 53, acting respectively between the inner ring 10 and the outer ring 12, at one end, and the printing unit, at the other end, maintain a frictional connection between respective cam rollers and the associated cam tracks 51.1 and 51.2. Thus, the movement of the control-cam arrangement 51 is accompanied by the positive control of the inner ring 10 and of the outer ring 12. Instead of a frictional effective connection between the cam followers 49 and 54, on the one hand, and the control-cam arrangement 51, on the other hand, it is also possible for the positive control to be accomplished with a corresponding positive form-fit effective connection. In that embodiment, which is not specifically illustrated herein, a control disc is provided with grooved cams.

The respective contours of the grooved cams and cam tracks 51.1 and 51.2 are determined by calculation, while the position of the bearing 41 is determined according to the criteria presented in conjunction with the exemplary embodiments shown in FIGS. 1 to 4.

We claim:

1. In a printing unit of an offset printing press having a rubber-blanket cylinder, a plate cylinder, an impression cylinder, and printing unit sidewalls, wherein, in operation, the rubber-blanket cylinder rolls on the plate cylinder and on a printing substrate supported on the impression cylinder, wherein the plate cylinder, the rubber-blanket cylinder and the impression cylinder each define a respective axis of rotation, the axes together spanning imaginary planes enclosing an imaginary prism with a triangular cross section having an obtuse vertex located on the axis of rotation of the rubber-blanket cylinder, and wherein the axes of rotation of the plate cylinder and of the impression cylinder are stationary with respect to the printing unit;

a positioning device for the rubber-blanket cylinder, the positioning device comprising:

bearing configurations each disposed in one of the side walls of the printing unit for rotatably supporting the rubber-blanket cylinder, said bearing configurations each comprising a pair of bearing rings including an inner ring, supporting the rubber-blanket cylinder and having an inner-ring axis, and an outer ring having an outer-ring axis, said outer ring rotatably supporting said inner ring and being rotatably mounted in one of the side walls; said bearing rings kinematically forming a crank with a coupling link including a first arm, swivellable about said outer-ring axis, defined with a first eccentricity on said outer ring, and a second arm, swivellable about said inner-ring axis, defined by a second eccentricity on said inner ring;

a transmission having a first end connected to a respective said inner ring and a respective said outer ring, and a second end connected to a positioning member, said transmission, when moved by said positioning member causing a simultaneous rotation of said inner ring and of said outer ring from a respective starting position into a respective end position and displacing the axis of rotation of the rubber-blanket cylinder along a positioning path defined transversely to the axis of rotation of the rubber-blanket cylinder;

starting positions of said inner ring and of said outer ring being defined such that the rubber-blanket cylinder is in engagement, under defined contact pressures, with the plate cylinder and with the impression cylinder;

said second arm of said crank having a length greater by a multiple than a length of said first arm of said crank;

said second arm of said crank being oriented along a first main direction substantially radial with respect to the axis of rotation of the plate cylinder, when said inner ring is in said starting position, in an end position and in transitional positions therebetween;

said first arm of said crank being oriented along a second main direction substantially perpendicular with respect to the first main direction, when said outer ring is in said starting position, in an end position and in transitional positions therebetween;

a rotation of said inner ring and of said outer ring from said starting positions into said end positions causing said axis of rotation of said rubber-blanket cylinder to increasingly move away from the plane spanned by the axes of rotation of the plate cylinder and of the impression cylinder, whereby the axis of rotation of the rubber-blanket cylinder first passes through a first positioning-path segment substantially describing an arc of a circle concentric with the plate cylinder; and subsequently passes through an adjoining second positioning-path segment becoming increasingly distant from the plate cylinder.

2. The positioning device according to claim 1, wherein said first and second positioning path segments together define a positioning path, said positioning path having a turning point at which said second positioning-path segment adjoins said first positioning-path segment.

3. The positioning device according to claim 1, which further comprises an adjustable stop operatively associated with said transmission, said stop limiting a displacement of the axis of rotation of the rubber-blanket cylinder in a direction from said second to said first positioning-path segment at a predeterimed location on said first positioning-path segment.

4. The positioning device according to claim 1, which further comprises adjusting means operatively associated with said pair of bearing rings for maintaining an instantaneous angular position of one ring of said pair of bearing rings while the other of said bearing rings is adjustably rotated relative to the one bearing ring.

5. The positioning device according to claim 1, wherein said transmission includes:

a driving rocker swivellable by said positioning means, said driving rocker having a first articulation point, a second articulation point, and being mounted in a stationary bearing with a swivel axis parallel to the axis of rotation of the rubber-blanket cylinder;

a first link having a first end articulated at said inner ring and a second end articulated at said first articulation point of said driving rocker; and a second link having a first end articulated at said outer ring and a second end articulated at said second articulation point of said driving rocker.

6. The positioning device according to claim 1, wherein said transmission includes:

a crank arm swivellable by said positioning means, said crank arm being mounted in a stationary crank bearing with a crank axis parallel to the axis of rotation of the rubber-blanket cylinder;

a coupling rod having a first end connected to one of said pair of bearing rings and a second end connected to said crank arm; and a guide lever having a first end connected to the other of said pair of bearing rings and a second end connected to said coupling rod, wherein said coupling rod, on the one hand, and the guide lever, on the other hand, have effective directions enclosing an angle different from 90°.

7. The positioning device according to claim 1, wherein said transmission includes:

a cam drive with a first cam follower connected to said inner ring, a second cam follower connected to said outer ring, and a control-cam operatively cooperating with said first and second cam followers, said control-cam having a first cam track controlling said first cam follower and a second cam track controlling said second cam follower;

said control-cam being adjustably connected to said positioning means.

8. The positioning device according to claim 7, wherein said cam drive includes a control disc carrying said first and second cam tracks.

* * * * *